US010837433B2

(12) United States Patent
Walmsley et al.

(10) Patent No.: US 10,837,433 B2
(45) Date of Patent: Nov. 17, 2020

(54) PORTABLE PUMP

(71) Applicant: Walmsley Developments Pty Ltd, Notting Hill (AU)

(72) Inventors: Albert Walmsley, Canning Vale (AU); Roland Walmsley, Canning Vale (AU); Byron Walmsley, Notting Hill (AU)

(73) Assignee: WALMSLEY DEVELOPMENTS PTY LTD, Victoria (AU)

( * ) Notice: Subject to any disclaimer, the term of this patent is extended or adjusted under 35 U.S.C. 154(b) by 170 days.

(21) Appl. No.: 16/013,255

(22) Filed: Jun. 20, 2018

(65) Prior Publication Data

US 2018/0372079 A1 Dec. 27, 2018

(30) Foreign Application Priority Data

Jun. 21, 2017 (AU) ..... 2017902379

(51) Int. Cl.
*F04B 35/06* (2006.01)
*F04B 39/12* (2006.01)
(Continued)

(52) U.S. Cl.
CPC ..... *F04B 35/06* (2013.01); *F04B 35/04* (2013.01); *F04B 39/0094* (2013.01);
(Continued)

(58) Field of Classification Search
CPC ..... F04B 35/04; F04B 35/06; F04B 49/022; F04B 39/121; F04B 39/0094; F04B 2201/0206; F04B 39/122
See application file for complete search history.

(56) References Cited

U.S. PATENT DOCUMENTS 3,776,666 A * 12/1973 Ludwig ..... F04B 15/00 417/411
4,033,511 A * 7/1977 Chamberlin ..... B05B 7/2416 239/346
(Continued)

FOREIGN PATENT DOCUMENTS

EP 0689645 A1 1/1996
EP 1003971 A2 5/2000
(Continued)

OTHER PUBLICATIONS

Communication Pursuant to Rule 114(2) EPC; Application No. 16829498.1-1104 / 3329124; dated Nov. 5, 2019; pp. 1-8.
(Continued)

*Primary Examiner* — Peter J Bertheaud
(74) *Attorney, Agent, or Firm* — Cantor Colburn LLP

(57) ABSTRACT

Disclosed is a portable pump including a reciprocating air compressor arrangement with a crank driving a connecting rod and a piston within a cylinder, the connecting rod being connected to the crank and piston, the crank actuating the piston in a reciprocating motion within and relative to the cylinder, an electric motor having a drive shaft mounted to the crank and rotatable about a drive shaft axis, the drive shaft axis being at least substantially coaxially aligned with an axis of rotation of the crank, a control unit communicating with the electric motor to control the pump, a power supply communicating with the control unit to power the control unit and electric motor, a common housing containing the electric motor, reciprocating air compressor arrangement, control unit, and power supply, and an outlet fluidly connected to the reciprocating air compressor arrangement for fluidly engaging with an pumpable object.

10 Claims, 3 Drawing Sheets

(51) Int. Cl.

| | |
|---|---|
| ***F04B 49/02*** | (2006.01) |
| ***F04B 39/00*** | (2006.01) |
| ***F04B 35/04*** | (2006.01) |
| *F04B 49/06* | (2006.01) |

(52) U.S. Cl.
CPC ..... *F04B 39/121* (2013.01); *F04B 39/122* (2013.01); *F04B 49/022* (2013.01); *F04B 49/06* (2013.01); *F04B 2201/0206* (2013.01); *F04B 2201/08* (2013.01)

(56) References Cited

U.S. PATENT DOCUMENTS

| | | | | | |
|---|---|---|---|---|---|
| 4,080,105 | A * | 3/1978 | Connell | F04B 35/04 | 137/224 |
| 4,187,058 | A * | 2/1980 | Fish | B60C 23/10 | 141/98 |
| 4,222,525 | A * | 9/1980 | Hildebrandt | B05B 7/2416 | 222/401 |
| 4,317,468 | A * | 3/1982 | Schwartz | F04B 39/125 | 137/540 |
| 4,389,166 | A * | 6/1983 | Harvey | F04B 35/04 | 417/234 |
| 4,627,797 | A * | 12/1986 | Rill, Jr. | A01K 63/047 | 417/411 |
| 4,715,787 | A | 12/1987 | Hung | | |
| 4,789,310 | A * | 12/1988 | Hung | A47L 5/24 | 15/339 |
| 5,127,808 | A * | 7/1992 | Nichols | B62J 11/00 | 417/234 |
| 5,370,504 | A | 12/1994 | Nagashima | | |
| 5,395,216 | A * | 3/1995 | Lin | F04B 23/06 | 417/234 |
| 5,639,226 | A * | 6/1997 | Boutrup | F04B 9/045 | 417/411 |
| 6,095,762 | A | 8/2000 | Wheeler | | |
| 6,439,104 | B1 | 8/2002 | Tonogai et al. | | |
| 6,524,082 | B2 | 2/2003 | Morita et al. | | |
| 9,777,718 | B2 | 10/2017 | Wang | | |
| 2001/0022939 | A1 | 9/2001 | Morita et al. | | |
| 2005/0047947 | A1 | 3/2005 | McCombs et al. | | |
| 2015/0337825 | A1 | 11/2015 | Chou | | |
| 2018/0051691 | A1* | 2/2018 | Li | F04B 49/12 | |

FOREIGN PATENT DOCUMENTS

| | | | |
|---|---|---|---|
| EP | 1605162 | A2 | 12/2005 |
| WO | 0129421 | A1 | 4/2001 |
| WO | 02057630 | A1 | 7/2002 |
| WO | 2010001427 | A1 | 1/2010 |
| WO | 2017015711 | A1 | 2/2017 |

OTHER PUBLICATIONS

Communication Pursuant to Rule 114(2) EPC; Application No. 18178860.5-004 / 3418567; dated Nov. 11, 2019; pp. 1-8.

EP Communication; Extended European Search Report; Application No. 16829498.1-1004 / 3329124 PCT/AU2016050666; dated Dec. 20, 2018; pp. 1-8.

EP Communication; Extended European Search Report; Application No. 18178860.5-1004; dated Sep. 18, 2018; pp. 1-8.

* cited by examiner

PORTABLE PUMP

CROSS-REFERENCE TO RELATED APPLICATIONS

This application claims the benefit of Australia Application No. 2017902379 filed Jun. 21, 2017, which is incorporated herein by reference in its entirety.

TECHNICAL FIELD

The present invention relates to a portable, hand-held pump and in particular a pump for filling objects with gases such as air.

BACKGROUND OF INVENTION

Pumps used to fill objects to a high pressure typically incorporate reciprocating air compressors. These types of compressors tend to be large and heavy in size and require an external power supply. This in turn makes such pumps difficult to transport and less useful if an external power supply is not readily available.

The above problems are exacerbated for cyclists who require portability, a pump that is light-weight, and one that pumps up tyres quickly. While some cyclists use carbon dioxide canisters (known as $CO_2$ inflators), these canisters have a number of disadvantages, including the fact that they are intended for only a single use. Another problem is that they become very cold during use and may expose a user to potential burns, particularly on their hands and fingers.

Other pumping solutions include traditional manual hand pumps, often designed to be releasably mounted to and carried on a bicycle frame. These are light-weight but are slow to use, in that they require a relatively large amount of time to inflate a tyre. It is also generally difficult to achieve tyre pressures above 80 psi using these types of pumps, which is usually considered too low a pressure for road bike tyres.

While some portable, battery powered air pumps do exist, they tend to be of a relatively large size, of substantial weight, and are designed to be stand-alone. However, due to the recent advances in high discharge lithium batteries, small, high pressure compressors are starting to be realised. The Applicant's International Patent Application WO2017/015711 describes a portable pump, whereby a reciprocating air compressor is actuated by a brushless motor via a gear assembly, and is powered by a high discharge lithium battery. The components are all contained within a thermally conductive housing thereby improving the thermal efficiency of the compressor.

A potential limitation noted by the Applicant in relation to their invention described in Patent Application WO2017/015711 is that it is impractical for a cyclist to carry the unit in their cycling jersey pocket, given the relatively large size of the unit. The relatively large size is mainly due to the use of a bulky gear assembly to drive the compressor via the brushless motor. As the pump is too large to directly engage onto a bicycle tyre's valve, a hose and fitting arrangement is provided to supply compressed air from the unit to the tyre. Further to this, the inflation time of the pump described in Patent Application WO2017/015711 is very sensitive to the compressor's compression ratio. Very high compression ratios are required to reduce the inflation time of a bicycle tyre. The high compression ratios require clearances smaller than 0.2 mm between the compressor's piston and the top of the compressor's cylinder when the piston is at top dead centre, and such clearances can only be achieved using expensive CNC machining processes. This adds significant time and cost to manufacturing of the compressor parts, which is undesirable.

It would therefore be desirable to provide a battery-powered pump design that is pocket sized, rechargeable, and can achieve fast pump up times that are less sensitive to the compressor's compression ratio.

Before turning to a summary of the present invention, it will be appreciated that the discussion of the background to the invention is included to explain the context of the invention. This is not to be taken as an addition that any of the material referred to is published, known or part of the common general knowledge.

SUMMARY OF THE INVENTION

According to a broad aspect of the present invention, there is provided a portable pump. The pump includes a reciprocating air compressor arrangement. The air compressor arrangement includes a crank that drives a connecting rod and a piston within a cylinder. The connecting rod has a first end and a second end. The first end of the connecting rod is connected to the crank and the second end of the connecting rod is connected to the piston. The crank is provided to actuate the piston in a reciprocating motion within and relative to the cylinder so as to compress air within the cylinder. The pump also includes an electric motor having a drive shaft mounted to the crank, with the drive shaft rotatable about a drive shaft axis. The drive shaft axis is at least substantially coaxially aligned with an axis of rotation of the crank. The pump further includes a control unit in electrical communication with the electric motor to control operation of the pump; as well as a power supply in electrical communication with the control unit to supply power to the control unit and electric motor. The electric motor, the reciprocating air compressor arrangement, the control unit and the power supply are each contained within a common housing. Further, the pump includes an outlet fluidly connected to the reciprocating air compressor arrangement for fluidly engaging with an object to be pumped.

In at least one preferred embodiment, the reciprocating air compressor arrangement has an inner cylinder diameter (d, in mm), a stroke (s, in mm) and a piston clearance at top dead centre (c, in mm), which meet the following design criteria:

$$1500<d^2(s-4.2c)<2200$$

wherein the piston clearance at top dead centre is a clearance between a top of the air compressor cylinder and the piston. More preferably, the following design criteria are met:

$$1500<d^2(s-4.2c)<3800$$

In such an embodiment, the clearance at the top dead centre (c) is preferably between 0.2 and 1.5 mm (and more preferably between 0.2 and 1.0 mm), the inner cylinder diameter (d) is preferably between 12.0 and 18.0 mm (and more preferably between 12.0 and 20.0 mm), and the piston stroke (s) range is preferably between 10.0 and 14.0 mm.

In a preferred form, the power supply is a rechargeable battery having a nominal voltage of between approximately 7 and 12 volts, a C rating of at least approximately 25, and a capacity of between approximately 200 and 600 mAh. The battery may be a lithium polymer battery, a lithium-ion battery, or the like. Advantageously, these batteries are also easy to recharge through use of an external power source such as a wall adaptor, and the batteries do not need to be removed from the unit to recharge them. Nevertheless, other suitable battery types may also be utilised.

The electric motor is preferably a brushless DC motor having a motor diameter of between approximately 25 and 35 mm (although a diameter between approximately 20 and 30 mm has previously been contemplated), a torque range of between approximately 100 and 300 mNm (although a torque range between approximately 100 and 200 mNm has previously been contemplated), and capable of operating at a speed of at least approximately 550 rpm/V when subjected to a compressor load. The electric motor is preferably a brushless DC motor, as opposed to a brushed DC motor of the type commonly found in typical air pumps—as brushless DC motors have much higher torque-to-weight ratios compared to conventional brushed DC motors. This allows for a smaller sized (and hence, lighter) motor to be used, whilst still providing enough torque to drive the compressor.

The pump preferably has a total weight of less than approximately 400 grams (although embodiments with less than approximately 250 grams have also been contemplated by the applicant), and can pump up at least one bicycle road bike tyre to approximately 100 psi on a single charge.

The housing preferably has a length of between approximately 55 and 95 mm (although lengths between approximately 55 and 75 mm have been previously contemplated by the applicant), a height of between approximately 50 and 70 mm, and a width of between approximately 30 and 45 mm (although widths of between approximately 25 and 35 mm have been previously contemplated). It is to be appreciated that these dimensions provide an extremely compact pump that can be easily carried in a cyclist's jersey pocket.

In a preferred form, the outlet is provided on or mounted to the housing. The outlet preferably includes a collar extending outwardly from the housing, with the collar including a valve receiving bore for receiving a valve of the object (such as a tyre) to be pumped. Preferably, the outlet that connects the reciprocating air compressor to the valve does not utilise a hose. The pump would therefore mount directly onto the tyre' s valve. Desirably, the pump can be manufactured compactly enough to fit between the spokes of a bicycle wheel, thereby enabling it to be directly mounted onto a bicycle tyre valve.

Preferably, the housing is made from a high strength, thermally conductive material such as aluminium. Moreover, the housing is preferably in contact with a portion of the pump's compressor, thereby acting as a heat sink. It does this by removing heat from the compressor via conduction. This arrangement adds negligible weight to the compressor whilst increasing the compressor's maximum run time and duty cycle. Using a high strength material such as aluminium, as opposed to low strength materials such as plastics, allows the housing to be manufactured with thin walls, thereby reducing the overall size of the pump.

The present invention improves on past approaches, as its design has been optimised for use as a pocket-sized, or miniature device that can pump up a bicycle tyre in less than a minute, can engage directly onto a bicycle tyre's valve without use of a hose and fittings, yet can be manufactured from cheap manufacturing processes such as casting processes. Further to this, the pump weighs less than 400 grams so as to not hinder the cyclist from a weight perspective. Accordingly, the pump of the present invention could be described as being "miniature" in size when compared to existing pump designs.

BRIEF DESCRIPTION OF DRAWINGS

It will be convenient to hereinafter describe a preferred embodiment of the invention with reference to the accompanying figures. The particularity of the figures is to be understood as not limiting the preceding broad description of the invention.

DETAILED DESCRIPTION

Figure 1:
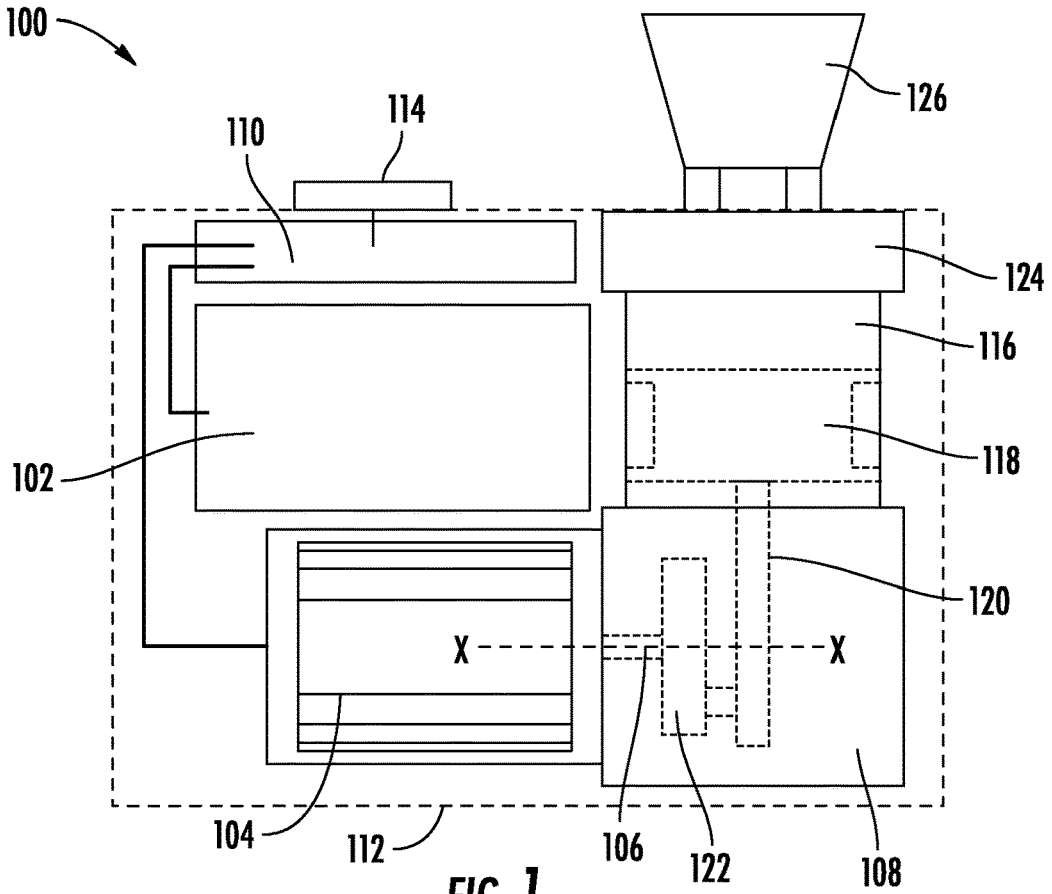
FIG. 1 is a schematic side view of the portable pump according to the present invention.

FIGS. 1 and 3 to 5 show a portable pump 100 according to the present invention.

The portable pump 100 includes a power supply 102, and an electric motor 104 having a drive shaft 106 that connects directly to a reciprocating air compressor 108. In this regard, the drive shaft 106 is rigidly mounted to the crank 122, with the rotation axes of the drive shaft 106 and the crank aligned along X-X (shown in FIG. 1).

A control unit 110 is provided, which is in electrical communication with the electric motor 104, and the power supply 102. The power supply 102, electric motor 104, drive shaft 106, reciprocating air compressor arrangement 108 and control unit 110 are all contained within a housing 112.

The control unit 110 may be a printed circuit board that consists of control circuitry that turns the motor ON and OFF via switch 114, and monitors the battery's voltage.

The reciprocating air compressor arrangement 108 includes a number of components which allow for the portable pump 100 to be miniature in size. The reciprocating air compressor arrangement 108 includes a cylinder 116, as well as a piston 118 connected to a connecting rod 120. The connecting rod 120 is connected to a crank 122 which is driven directly by the motor's drive shaft 106, rather than the drive shaft 106 driving the crank 122 via a gear assembly.

The piston 118 preferably further includes a sealing arrangement (not shown) which ensures compressed air is maintained within the cylinder 116 during the compression process.

In operation, the portable pump 100 is turned on by a user via switch 114. Once turned on, the electric motor 104 starts running which, in turn, rotates the drive shaft 106. The rotating drive shaft 106 turns/rotates the crank 122, causing the connecting rod 120 and piston 118 to reciprocate axially within the cylinder 116. One-way valves (not shown) located on the top surface of the piston 118 as well as inside the compressor head 124 ensure that air is compressed inside the cylinder 116 and forced through the outlet 126. This process is carried out many times a second as the piston 118 axially reciprocates within the cylinder 116.

Advantageously, the arrangement of the portable pump 100 allows it to be manufactured small enough so that it can be mounted directly onto a tyre valve. Indeed, the pump 100 can be considered to be of a miniature size when compared to existing pump designs. This means that no additional hose or fittings are required to transfer the compressed air to the tyre, as the pump can fit between most conventional 700 mm diameter bicycle wheel spoke configurations and directly onto the tyre valve, thereby further reducing the size and weight of the pump 100. The pump 100 is manufactured without a gearbox or outlet hose, and so this enables the pump 100 to be of a very small size when compared to existing pump designs. The pump 100 has a length only in the order of approximately 55 to 95 mm, a height of only approximately 50 to 70 mm and a width of only approximately 30 to 45 mm. These small dimensions allow the pump to fit easily into a cyclist's jersey pocket.

For a high pressure, direct-drive (i.e. no gearing) portable/miniature pump to be realised, the compressor's compression ratio needs to be optimised so that a small, brushless motor can be utilised, while achieving a pump up time of less than 1 minute. The diameter of the brushless motor must be small enough so that it fits inside the pump, and therefore motor diameters ranging from 25-35 mm need to be considered. At the time of writing, low cost 25-35 mm diameter brushless DC motors that are fitted with rare earth, permanent magnets can achieve motor torques ranging from 100 to 300 mNm. Therefore, the compressor should be designed so that it can be driven by a motor that can produce this level of torque.

Figure 2:
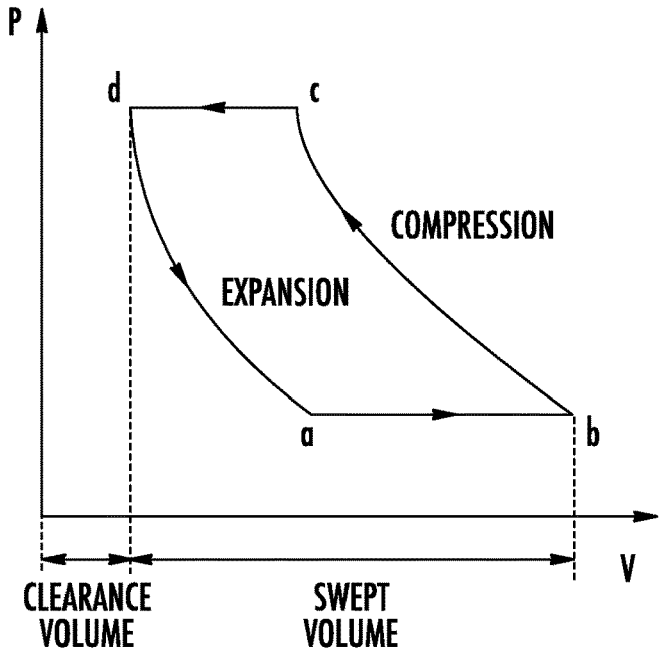
FIG. 2 shows a typical pressure versus volume (PV) diagram for a reciprocating air compressor.

To determine the required motor torque, one must consider the pressure-volume (PV) diagram of a reciprocating compressor, as shown in FIG. 2. The swept volume ($V_b$–$V_d$) and the clearance volume ($V_d$) can be calculated using:

$$V_b - V_d = \pi\left(\frac{d}{2}\right)^2 s \tag{1}$$

$$V_d = \pi\left(\frac{d}{2}\right)^2 c \tag{2}$$

Where d is the diameter of the cylinder, s is the stroke of the piston, and c is the clearance of the piston from the top of the cylinder when the piston is at top-dead centre. From Equations (1) and (2) $V_b$ is easily determined. Assuming that the compression and expansion of air is a reversible polytropic process ($PV^n$=constant) Equation (2) can be used to determine $V_a$, and therefore the induced volume ($V_b$–$V_a$) can be calculated using:

$$V_b - V_a = \eta_c \pi\left(\frac{d}{2}\right)^2\left[s + c - c\left(\frac{P_d}{P_a}\right)^{\frac{1}{n}}\right] \tag{3}$$

where $\eta_c$ is the efficiency of the compressor and n is the polytropic index. Equation (3) can then be substituted into Equation (4), which calculates the mass flow rate (m) of air entering the compressor:

$$m = \frac{P_a\omega(V_b - V_a)}{RT} \tag{4}$$

Where ω is the motor speed (in Hz), R is Boltzmann's gas constant (in J/kgK) and T is the temperature of the air entering the cylinder.

The indicated power (IP) of the compressor can then be calculated using the following equation:

$$IP = \left(\frac{n}{n-1}\right)mR\left(T\left(\frac{P_d}{P_a}\right)^{\frac{(n-1)}{n}} - T\right) \tag{5}$$

Once IP is known, the mean effective pressure (P) acting on the top surface of the piston can be calculated using the following equation:

$$P = \frac{IP}{\omega(V_b - V_d)} \tag{6}$$

Finally, an estimate of the required motor torque (τ) can be calculated using:

$$\tau = \frac{P\pi d^2 s}{8} \tag{7}$$

Substituting Equations (1-6) into Equation (7) yields the following:

$$\tau = \frac{\pi d^2 P_a \eta_c}{8T_i}\left(\frac{n}{n-1}\right)\left(s + c - c\left(\frac{P_d}{P_a}\right)^{\frac{1}{n}}\right)\left(T_i\left(\frac{P_d}{P_a}\right)^{\frac{(n-1)}{n}} - T_i\right) \tag{8}$$

Assuming ambient conditions, Equation (8) can be simplified to the following design equation, which can be used to optimise the compressor's critical dimensions d, s and c to ensure the chosen brushless motor can provide sufficient torque:

$$1500<\beta<3800 \tag{9}$$

Where $\beta=d^2(s-4.2c)$ (dimensions in mm). Equation (7) assumes the chosen brushless motor can provide motor torques ranging from 100-300 mNm.

Further to this, the pump must be able to pump up tyres fast enough so that the pumping process is not laborious for the user. Ideally, a standard-sized road bike tyre should be able to be pumped from 0 psi to 100 psi in less than one minute. An estimate of tyre pump up times (t) can be determined from the pumps free air delivery (FAD):

$$t = \frac{V_t(P_d - P_a)}{P_a FAD} \tag{10}$$

Where $V_t$ is the tyre volume and $$FAD=\omega(V_b-V_a)$$

Substituting Equations (3) and (10) into Equation (11), and assuming ambient conditions, the following equation can be used to estimate a pump up time for a given value of β (in mm units) and motor speed $\omega_{rpm}$ (in revolutions per minute):

$$t = \frac{540\times10^6}{\beta\omega_{rpm}} \tag{12}$$

As the brushless motor is not geared, its speed will reduce significantly with increasing tyre pressure during pumping. However, the inventors found that by increasing the clearance (c) to a value ranging from the usual 0-0.2 mm size for a highly efficient compressor out to 0.2-1.0 mm, the reduction in motor speed was less. This reduction easily accounted for lower β values due to larger clearances, and fast pump up times were maintained. Further to this, the large range in allowable clearances makes the compressor easier to manufacture with higher yields.

Experiments carried out by the inventors showed that when utilising the following compressor dimensions:

Inner cylinder diameter (d): 12-20 mm

Stroke (s): 10-14 mm

Clearance (c): 0.2-1.0 mm

Brushless motors of 25-35 mm diameter when driven with 7-12 volts could easily achieve pump up times of less than 60 seconds, provided the brushless motors were designed to rotate at speeds equal to, or greater than 550 rpm/V under compressor load. The 7-12 volt voltage requirements allow the pump to be powered from either a 2-cell or 3-cell high discharge lithium battery.

Figure 3:
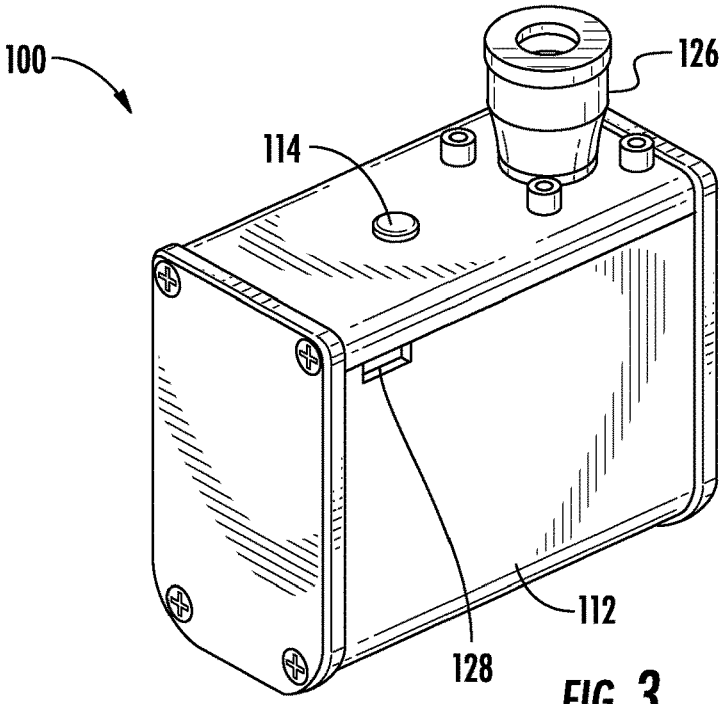
FIG. 3 shows an isometric view of the portable pump shown in FIG. 1.
Figure 4:
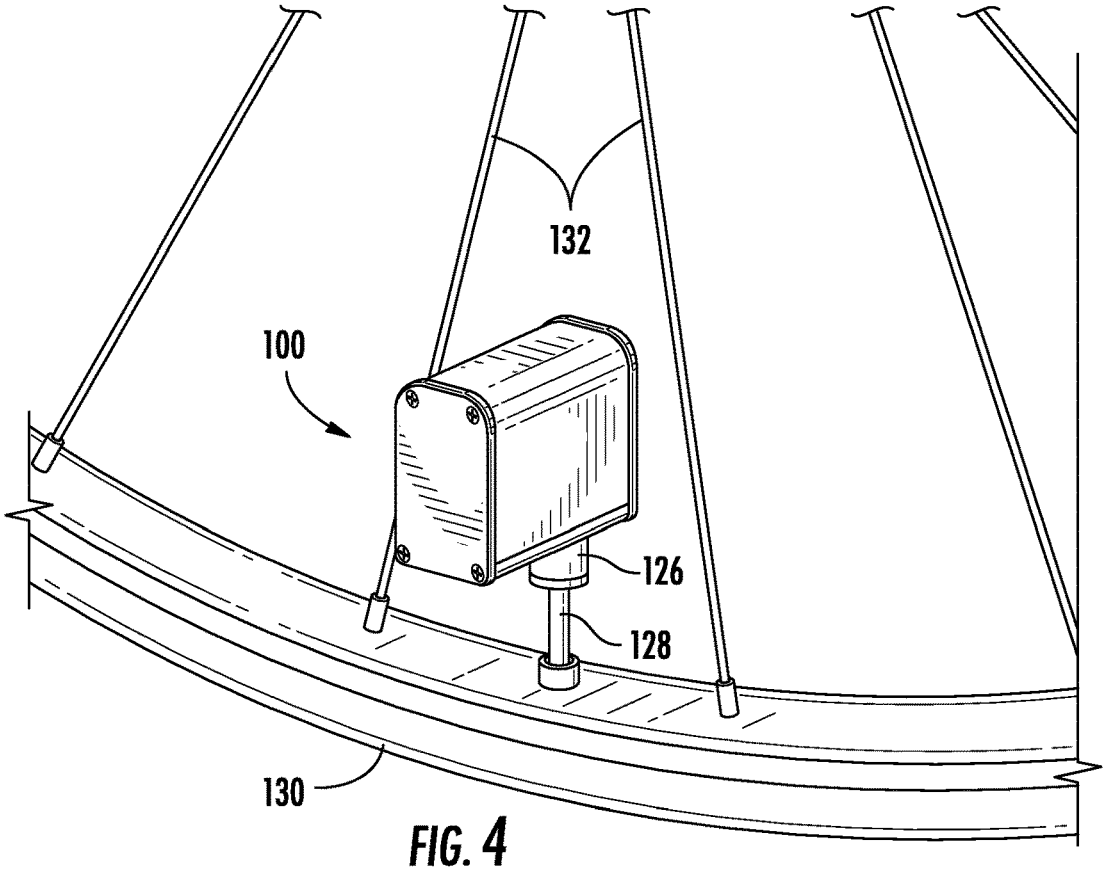
FIG. 4 shows the portable pump of in FIG. 1 when engaging a bicycle tyre valve.

FIG. 3 shows the miniature pump 100 in isometric view. Charge port 128 allows the use of an external charger to charge the pump's internal battery. FIG. 4 shows the miniature pump 100 when engaged onto a valve 128 of a bicycle tyre 130 via the pump's outlet 126. As the unit is so small, it easily fits between the spokes 132 of the bicycle wheel without use of a hose. However, for wheel designs that did not allow for a direct connection (i.e. disc wheels), the pump's outlet 126 can be replaced by an optional hose.

One of the main dimensional constraints of the pump 100 is the size of the rechargeable battery 102. The battery 102 must be small enough to fit inside the housing 112 of the pump 100, yet be able to provide enough current to pump up at least one bicycle tyre before a recharge is required. The battery 102 must also be able to handle the high currents required to drive the compressor arrangement 108, without affecting is performance, or worse, being damaged due to excessive current draw.

The rate (C) at which a battery 102 can be safely discharged is dependent on both the maximum discharge current (I) that the battery experiences, and the battery's capacity (ρ). These three variables are related as follows:

$$I=\rho C \tag{13}$$

Experiments have shown that for the pump 100 to be realised, rechargeable batteries must be manufactured with C ratings of at least 25, otherwise the battery's capacity is significantly reduced after prolonged use.

The amount of torque that a brushless motor can deliver is estimated as follows:

$$\tau = \frac{30I}{\pi Kv} \tag{14}$$

Where Kv is the motor's speed (in units rpm/V). Substituting Equation (13) into Equation (14) and rearranging allows us to determine the minimum battery capacity requirements for the miniature pump:

$$\rho[\text{mAh}]>4\tau Kv \tag{15}$$

For brushes motors with torques of at least 100 mNm and speeds of at least 550 rpm/V, Equation (15) suggests the pump's battery must have a capacity of at least 200 mAh. At the time of writing, commercially available high-discharge lithium batteries with C ratings greater than 25, and with capacities ranging from 200-600 mAh were able to fit inside the housing 112 of the pump 100, assuming the dimensions of the housing 112 ranged from 55-95 mm in length, 50-70 mm in height and 30-45 mm in thickness. It was also determined that batteries of these capacities were able to pump up at least one road bike tyre to 100 psi without the need to be recharged.

Figure 5:
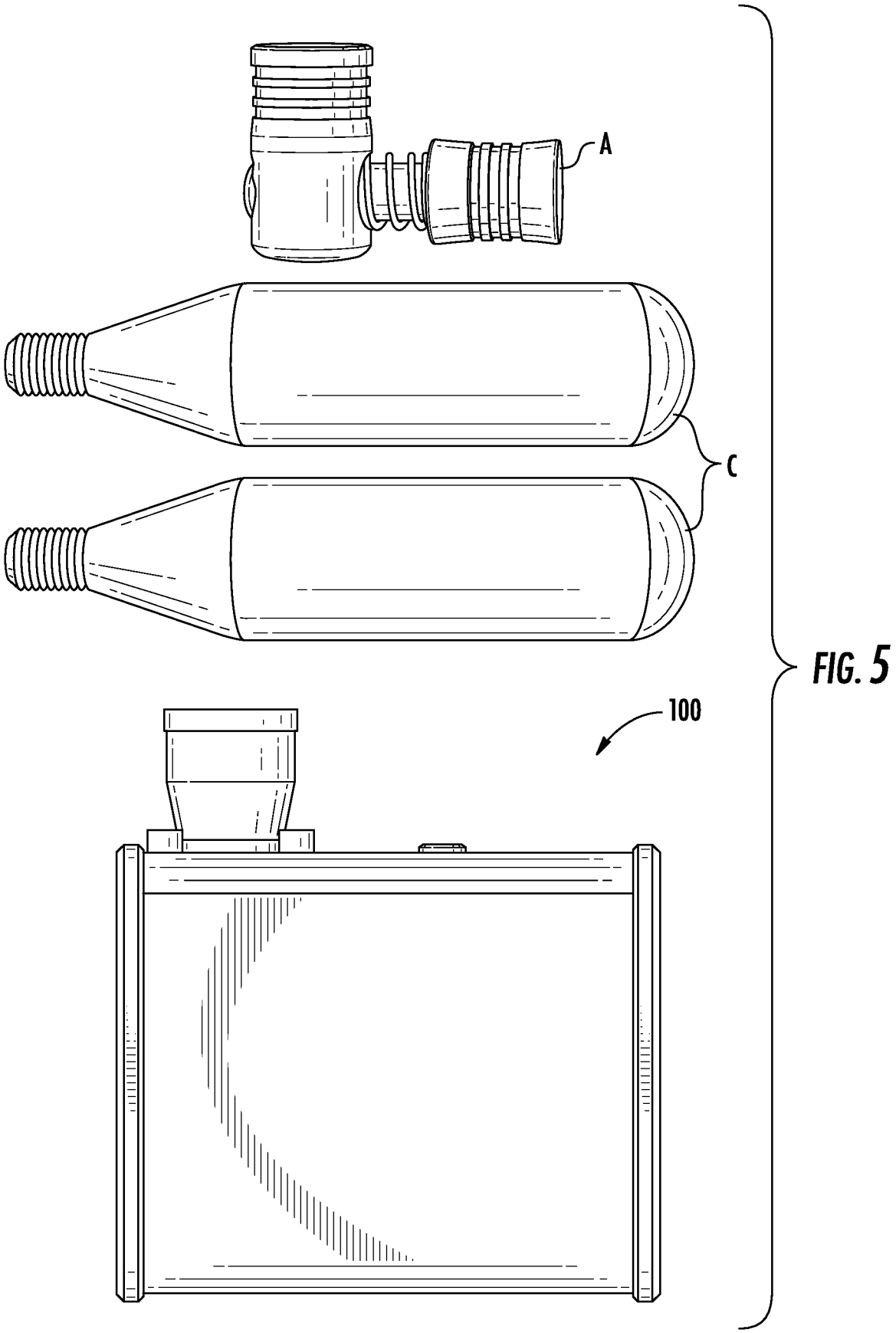
FIG. 5 is a photograph of the portable pump of FIG. 1, when shown in a size comparison with two conventional CO2 canisters and a canister adaptor.

FIG. 5 has been provided for purely comparative purposes, to further highlight the small (ie. miniature) size of the pump 100. A cyclist carrying the pump 100 in a rear pocket of their jersey would require similar pocket space as when carrying two CO2 canisters C and the associated adaptor/connector A. Thus, the cyclist should be easily able to carry the pump 100 instead of the canisters and adapter.

It is to be understood that various alterations, modifications and/or additions may be introduced into the construction and arrangement of the parts previously described without departing from the spirit or ambit of this invention.

The invention claimed is:

1. A gearless portable pump capable of inflating a bicycle tire to 100 psi, comprising:

a reciprocating air compressor arrangement comprising: a crank that drives a connecting rod and a piston within a cylinder, the connecting rod having a first end and a second end, the first end of the connecting rod connected directly to the crank and the second end of the connecting rod connected directly to the piston, with the crank provided to actuate the piston in a reciprocating motion within and relative to the cylinder so as to compress air within the cylinder;

a brushless electric motor having a drive shaft mounted directly to the crank, with the drive shaft rotatable about a drive shaft axis, and with the drive shaft axis at least substantially coaxially aligned with an axis of rotation of the crank;

a control unit in electrical communication with the electric motor to control operation of the pump;

a power supply comprising a rechargeable battery in electrical communication with the control unit to supply power to the control unit and electric motor;

the electric motor, the reciprocating air compressor arrangement, the control unit and the power supply each contained within a common housing; and an outlet fluidly connected to the reciprocating air compressor arrangement for fluidly engaging with an object to be pumped;

wherein the reciprocating air compressor arrangement has an inner cylinder diameter (d, in mm), a stroke (s, in mm) and a piston clearance at top dead center (c, in mm), which meet the following design criteria:

$$1500<d^2(s-4.2c)<3800$$

wherein the piston clearance at top dead center is a clearance between a top of the air compressor cylinder and the piston.

2. The gearless portable pump according to claim 1, wherein the clearance at the top dead center (c) is between 0.2 and 1.0 mm.

3. The gearless portable pump according to claim 1, wherein the inner cylinder diameter (d) is between 12.0 and 20.0 mm.

4. The gearless portable pump according to claim 1, wherein the piston stroke (s) is between 10.0 and 14.0 mm.

5. The gearless portable pump according to claim 1, wherein the rechargeable battery has a nominal voltage of between approximately 7 and 12 volts, a C rating of at least approximately 25, and a capacity of between approximately 200 and 600 mAh.

6. The gearless portable pump according to claim 1, wherein the electric motor is a brushless DC motor having a motor diameter of between approximately 25 and 35 mm, a torque range of between approximately 100 and 300 mNm, and capable of operating at a speed of at least 550 rpm/V when subjected to a compressor load.

7. The gearless portable pump according to claim 1, wherein the pump has a total weight of less than 400 grams.

8. The gearless portable pump according to claim 1, wherein the housing has a length of between approximately 55 and 95 mm, a height of between approximately 50 and 70 mm, and a width of between approximately 30 and 45 mm.

9. The gearless portable pump according to claim 1, wherein the outlet is provided on or mounted to the housing.

10. The gearless portable pump according to claim 9, wherein the outlet comprises a collar extending outwardly from the housing, the collar comprising a valve receiving bore for receiving a valve of the object to be pumped.

* * * * *